US011290825B1

(12) United States Patent
Ko et al.

(10) Patent No.: US 11,290,825 B1
(45) Date of Patent: Mar. 29, 2022

(54) SPEAKER UNIT FOR EARPHONE

(71) Applicant: ALMUS Corp., Chungcheongnam-do (KR)

(72) Inventors: Ju Heon Ko, Gyeonggi-do (KR); Jong Won Lee, Incheon (KR); Byung Il Min, Gyeonggi-do (KR); Yun Uk Ha, Incheon (KR); Jeong Kwon Park, Gyeonggi-do (KR)

(73) Assignee: ALMUS Corp., Chungcheongnam-do (KR)

( * ) Notice: Subject to any disclaimer, the term of this patent is extended or adjusted under 35 U.S.C. 154(b) by 0 days.

(21) Appl. No.: 17/163,786

(22) Filed: Feb. 1, 2021

(30) Foreign Application Priority Data

Nov. 12, 2020 (KR) ..... 10-2020-0151071

(51) Int. Cl.
*H04R 9/06* (2006.01)
*H04R 1/10* (2006.01)
*H04R 9/02* (2006.01)

(52) U.S. Cl.
CPC ..... *H04R 9/06* (2013.01); *H04R 1/1075* (2013.01); *H04R 9/025* (2013.01)

(58) Field of Classification Search
CPC combination set(s) only.
See application file for complete search history.

(56) References Cited

U.S. PATENT DOCUMENTS

2017/0033652 A1* 2/2017 Mao ..... H02K 33/16
2017/0099536 A1* 4/2017 Schoeffmann ..... H04R 1/06

FOREIGN PATENT DOCUMENTS

CN 103227973 A * 7/2013 ..... H04R 19/02
CN 108401215 A * 8/2018 ..... H04R 9/046
CN 211509289 U * 9/2020
GB 2461929 A * 1/2010 ..... H04R 1/345
JP 2003111194 A * 4/2003 ..... H04R 1/24
KR 10-2252018 B1 5/2021
WO WO-2006089995 A1 * 8/2006 ..... H04R 9/10

OTHER PUBLICATIONS

Office Action from corresponding Korean Patent Application No. 10-2020-0151071, dated Oct. 28, 2021.

* cited by examiner

*Primary Examiner* — Angelica M McKinney

(74) *Attorney, Agent, or Firm* — Harness, Dickey & Pierce, P.L.C.

(57) ABSTRACT

A speaker unit for an earphone may include a frame; a magnet; a first plate fixed to the frame and in contact with one side of the magnet; a second plate fixed to the frame and in contact with the other side of the magnet; a first coil and a second coil that are disposed to overlap the magnet and the plate in a radial direction; a first diaphragm disposed in front of the magnet and having the first coil fixed thereto; a second diaphragm disposed behind the magnet; and a flexible printed circuit board (FPCB), wherein the FPCB includes a first region including a first contact point connected to the first coil and a second region including a second contact point connected to the second coil and in a front-to-rear direction, the first region is disposed to overlap the first diaphragm in a front-to-rear direction.

14 Claims, 17 Drawing Sheets

SPEAKER UNIT FOR EARPHONE

CROSS-REFERENCE TO RELATED APPLICATION

This application claims the benefit under 35 USC § 119(a) of Korean Patent Application No. 10-2020-0151071, filed on Nov. 12, 2020, in the Korean Intellectual Property Office, the entire disclosure of which is incorporated herein by reference for all purposes.

FIELD

The following description relates to a speaker unit for an earphone.

BACKGROUND

An earphone includes, inside a housing, a speaker unit that generates sound waves.

The speaker unit may include a frame, a diaphragm, and a coil and a substrate which are fixed to the diaphragm. The substrate is connected to the coil, supplying an electric signal to the coil. The substrate may be disposed in the frame. A pad that is heat-bonded to a lead wire of the coil is attached to the substrate. The substrate is required to have a wide width in the radial direction of the earphone in order to secure an area to which the pad is attached. In particular, in the case of an earphone including a speaker unit for emitting sound in a high frequency range and a speaker unit for emitting sound in a low frequency range, the number of pads increases, and correspondingly, a wider width of the substrate is required.

Therefore, a reinforcing plate to support the substrate is also required to have a wide width in the radial direction corresponding to the size of the substrate. However, the size of the diaphragm is limited due to the space in the radial direction occupied by the substrate and the reinforcing plate that supports the substrate, and thus the intensity and the reproduction range of sound of the earphone are limited.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An object of the present invention is to provide a speaker unit capable of increasing the intensity and the reproduction range of sound by securing the size of a diaphragm.

The object to be achieved by the present invention are not limited to the foregoing objective, and additional objectives, which are not mentioned herein, will be readily understood by those skilled in the art from the following description.

In one general aspect, there is provided a speaker unit for an earphone, including a frame, a magnet, a first plate fixed to the frame and in contact with one side of the magnet, a second plate fixed to the frame and in contact with the other side of the magnet, a first coil and a second coil that are disposed to overlap the magnet and the plate in a radial direction, a first diaphragm disposed in front of the magnet and having the first coil fixed thereto, a second diaphragm disposed behind the magnet, and a flexible printed circuit board (FPCB), wherein the FPCB includes a first region including a first contact point connected to the first coil and a second region including a second contact point connected to the second coil, and in a front-to-rear direction, the first region is disposed to overlap the first diaphragm in a front-to-rear direction while the second region is disposed not to overlap the first diaphragm.

Preferably, the first region and the second region may be disposed apart from each other in the radial direction, and the FPCB may include a third region that electrically connects the first region and the second region.

Preferably, the speaker unit may further include a terminal disposed on the frame, wherein one side of the terminal may be connected to the second coil and the other side of the terminal may be connected to the second contact point.

Preferably, in the front-to-rear direction, ends of the terminal may be disposed higher than the FPCB.

Preferably, the terminal may include a first terminal connected to a third lead wire on one side of the second coil and a second terminal connected to a fourth lead wire on the other side of the second coil, the first terminal may be disposed on one side of a reference line that passes through a center of the second coil in the radial direction, and the second terminal may be disposed on the other side of the reference line.

Preferably, the first region may be disposed on the first plate, the speaker unit may include a fixing ring for fixing the first diaphragm, and the first region may be disposed between the first coil and the fixing ring in the radial direction.

Preferably, the first contact point may include contact point 1a in contact with a first lead wire of the first coil and contact point 1b in contact with a second lead wire of the first coil, and with respect to a reference line passing through a center of the first coil in the radial direction, the contact point 1a may be disposed on one side of the reference line and the contact point 1b may be disposed on the other side of the reference line.

Preferably, the second contact point may include contact point 2a in contact with a third lead wire of the second coil and contact point 2b in contact with a fourth lead wire of the second coil, and with respect to a reference line passing through the center of the second coil in the radial direction, the contact point 2a may be disposed on one side of the reference line and the contact point 2b may be disposed on the other side of the reference line.

Preferably, the first region may be of a ring shape or an arc shape.

Preferably, the magnet may include magnet 1a and magnet 1b that are disposed along a circumferential direction, the magnet 1a and the magnet 1b may be disposed apart from each other with a space therebetween, and a third lead wire and a fourth lead wire of the second coil may be disposed in the space.

Preferably, the frame may include a first receiving portion and a second receiving portion that are disposed apart from each other along a circumferential direction, and a third receiving portion disposed between the first receiving portion and the second receiving portion, the magnet may be disposed in each of the first receiving portion and the second receiving portion, and a second lead wire of the second coil may be positioned in the third receiving portion.

Preferably, the frame may include a first receiving portion and a second receiving portion that are disposed apart from each other along a circumferential direction, and a third receiving portion disposed between the first receiving portion and the second receiving portion, the magnet may be disposed in each of the first receiving portion and the second receiving portion, and a second lead wire of the second coil may be positioned in the third receiving portion.

Preferably, the speaker unit may further include a terminal connected to the second lead wire of the second coil, and the frame may include a terminal mounting portion disposed in the third receiving portion and having the terminal mounted thereon.

Preferably, the first plate may include a hole in which the first coil is positioned, a first groove disposed along a circumference of the hole and having the second region disposed therein, and a second groove connected to the first groove and having the third region disposed therein.

Preferably, the frame may include a first guide protruding inward from an inner surface thereof, the first plate may include a second guide protruding radially from an outer surface thereof, and a position of the first plate may be aligned as the second guide is in contact with the first guide.

Other features and aspects will be apparent from the following detailed description, the drawings, and the claims.

Figure 1:
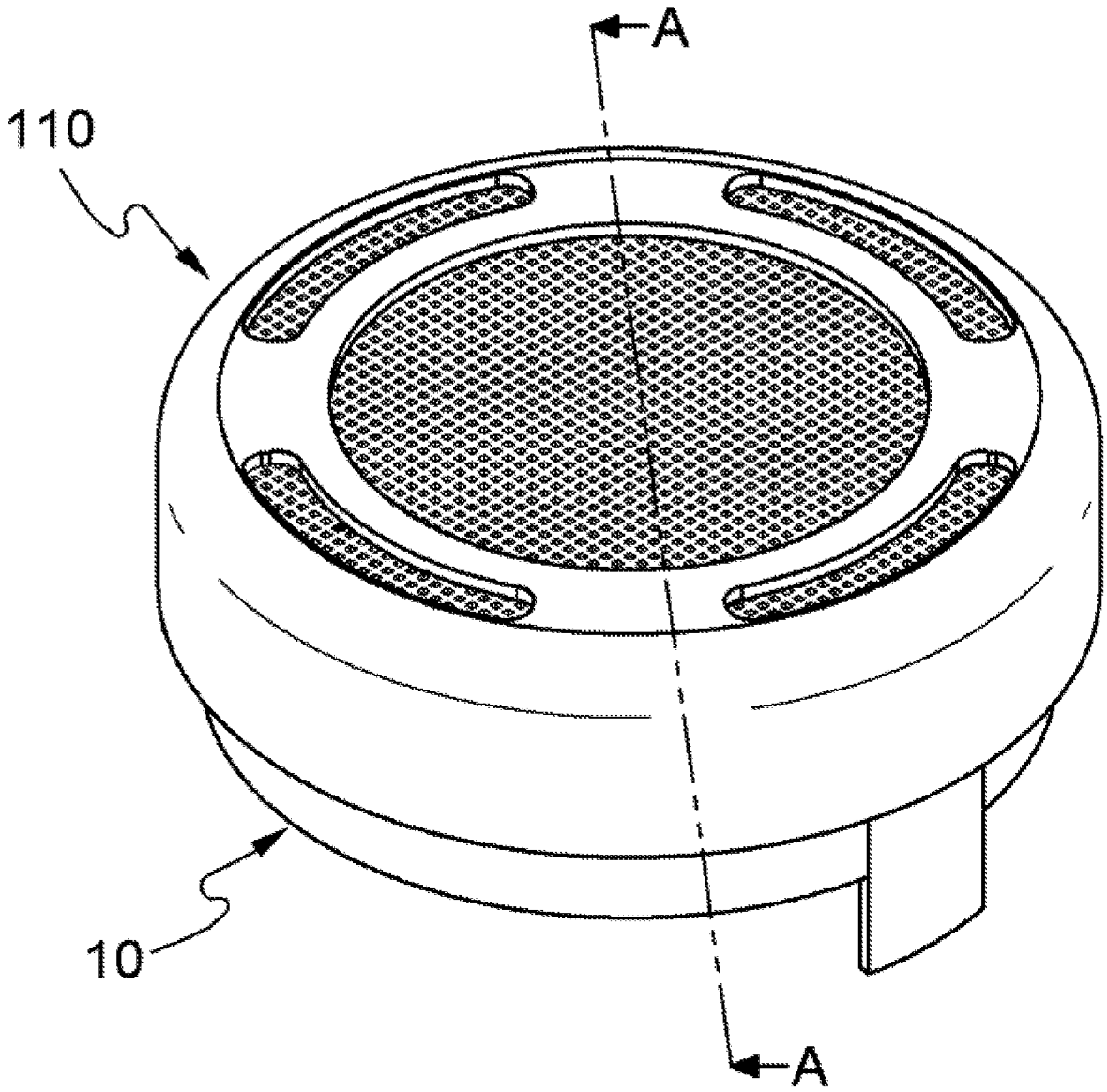
FIG. 1 is a diagram illustrating a speaker unit according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The objects, features and advantages of the present invention will be more clearly understood from the following detailed description and preferred embodiments taken in conjunction with the accompanying drawings. In the present specification, reference now should be made to the drawings, in which the same reference numerals are used throughout the different drawings to designate the same or similar components. Further, in the description of the present invention, if detailed descriptions of related well-known constructions or functions are determined to make the gist of the present invention unclear, the detailed descriptions will be omitted.

Hereinafter, a speaker unit according to an embodiment will be described in detail with reference to the accompanying drawings.

Figure 2:
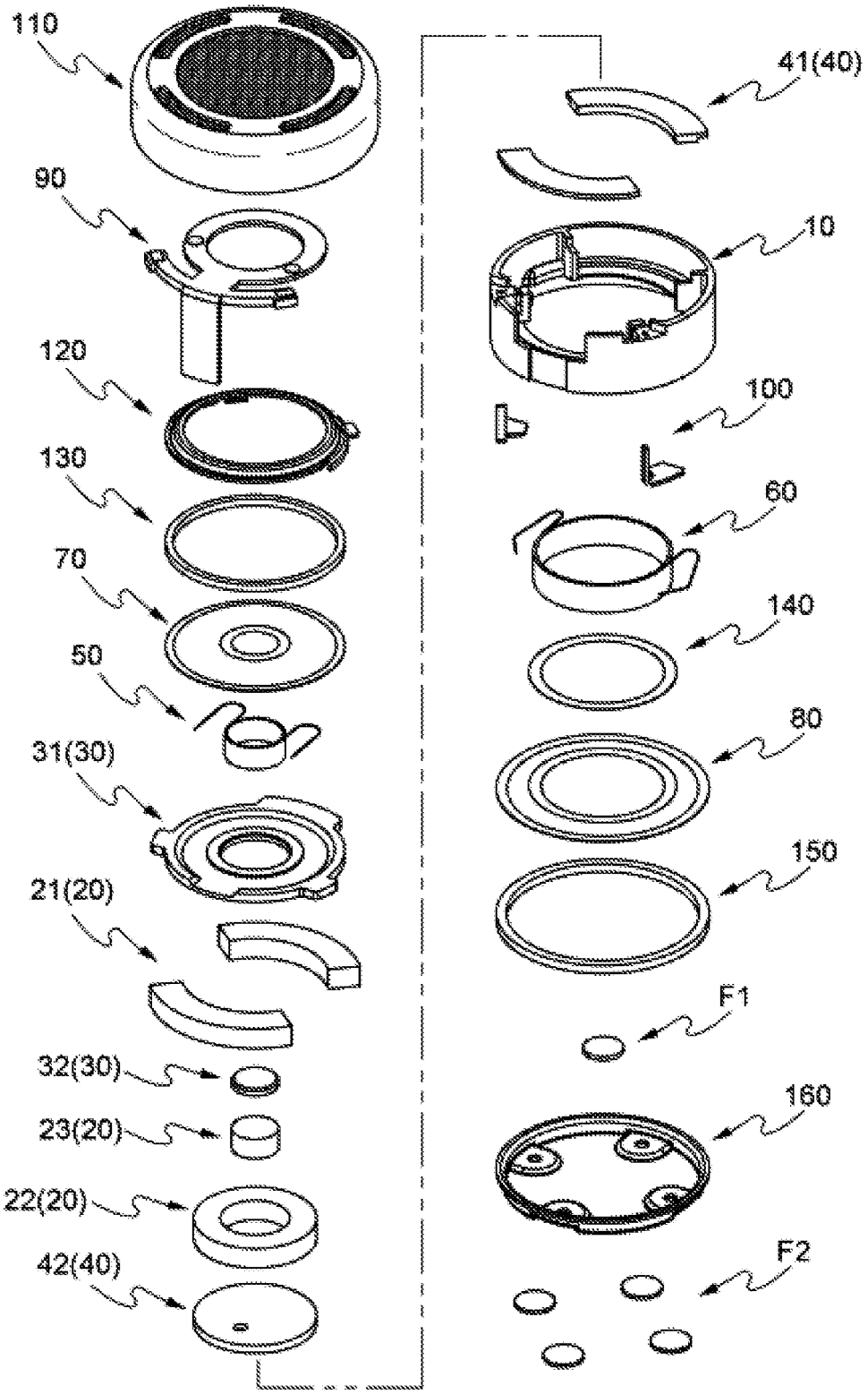
FIG. 2 is an exploded view of the speaker unit shown in FIG. 1.
Figure 3:
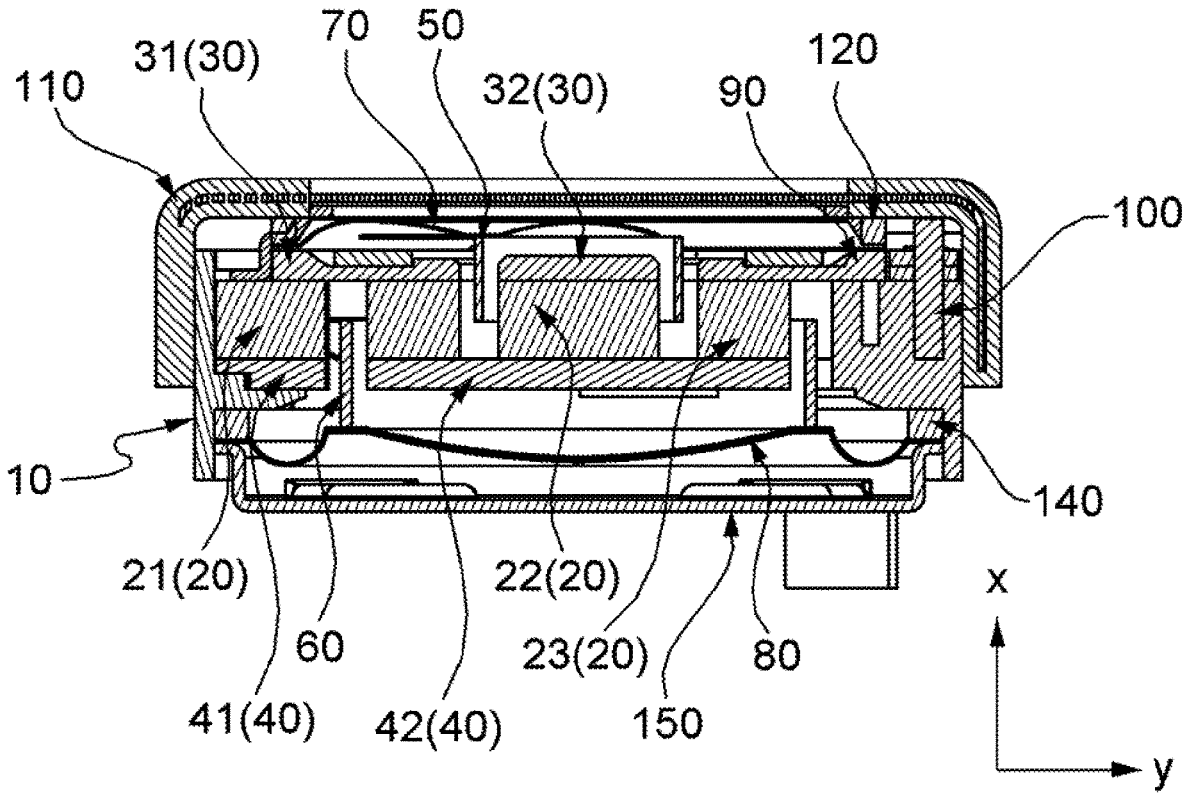
FIG. 3 is a side cross-sectional view taken along line A-A in FIG. 1.

FIG. 1 is a diagram illustrating a speaker unit according to an embodiment, FIG. 2 is an exploded view of the speaker unit shown in FIG. 1, and FIG. 3 is a side cross-sectional view taken along line A-A in FIG. 1.

Referring to FIGS. 1 to 3, the term "front" refers to a direction toward a protector 110 and "rear" refers to a direction opposite to the front. In addition, in the drawings below, the x-axis represents the direction between the front and rear of an earphone and the y-axis represents the radial direction of the earphone.

The speaker unit according to an embodiment includes both configurations (two-way type) for reproducing sound in a low frequency range and sound in a high frequency range. In addition, in the speaker unit according to an embodiment, an area of a flexible printed circuit board (FPCB) 90 is separated and a portion thereof is disposed to overlap a first diaphragm 70 in the front-to-rear direction, so that the size of the first diaphragm 70 is secured to the maximum.

The speaker unit according to an embodiment includes a frame 10, a magnet 20, a first plate 30, a second plate 40, a first coil 50, a second coil 60, the first diaphragm 70, a second diaphragm 80, and the FPCB 90.

The frame 10 may be a cylindrical member.

The magnet 20 electromagnetically interacts with the first coil 50 and the second coil 60. The magnet 20 may include a first magnet 21, a second magnet 22, and a third magnet 23. The first magnet 21 may be disposed outside the second coil 60 and fixed to the frame 10. The second magnet 22 may be disposed inside the first coil 50. The third magnet 23 may be disposed between the first coil 50 and the second coil 60 in the radial direction.

With respect to the radial direction of the earphone, the second magnet 22 is positioned innermost, the first magnet 21 is positioned outermost, and the third magnet 23 is positioned between the second magnet 22 and the first magnet 21.

The first magnet 21 may be formed of a plurality of magnets 20 in a curved bar shape. The second magnet 22 may be of a ring shape. The third magnet 23 may be of a cylindrical shape.

The first magnet 21 and the third magnet 23 are configured to reproduce sound in a low frequency range, and the second magnet 22 and the third magnet 23 are configured to reproduce sound in a high frequency range.

The first plate 30 is brought in contact with one surface of the magnet 20 so that a magnetic field is created. The first plate 30 may include plate 1a 31 and plate 1b 32. The plate 1a 31 may be of a ring shape. The plate 1a 31 is in contact with one surface of the first magnet 21 and one surface of the third magnet 23. The plate 1b 32 may be of a disc shape. The plate 1b 32 is in contact with one surface of the second magnet 22.

The second plate 40 is brought in contact with the other surface of the magnet 20 so that a magnetic field is created.

The second plate 40 may include plate 2a 41 and plate 2b 42. The plate 2a 41 may be an arc-shaped plate. The plate 2a 41 is in contact with the other surface of the first magnet 21. The plate 2b 42 may be of a disc shape. The plate 2b 42 is in contact with one surface of the second magnet 22 and one surface of the third magnet 23.

The first coil 50 is fixed to the first diaphragm 70. When the first coil 50 moves, the first diaphragm 70 moves according to the movement of the first coil 50. The first coil 50 may be disposed between the second magnet 22 and the third magnet 23 in the radial direction. Also, the first coil 50 may be disposed between the plate 1a 31 and the plate 1b 32 in the radial direction. Accordingly, the first coil 50 is disposed such that a portion thereof overlaps the second magnet 22 and the third magnet 23 in the radial direction. Additionally, the first coil 50 is disposed such that a portion thereof overlaps the first plate 30 in the radial direction. The first coil 50 may be provided to reproduce sound in a high frequency range.

The second coil 60 may be disposed outside the first coil 50 in the radial direction. Also, the second coil 60 may be disposed on one side of the first coil 50 in the front-to-rear direction. The second coil 60 is fixed to the second diaphragm 80. When the second coil 60 moves, the second diaphragm 80 moves according to the movement of the second coil 60. The second coil 60 may be disposed between the first magnet 21 and the third magnet 23 in the radial direction. Also, the second coil 60 may be disposed between the plate 2a 41 and the plate 2b 42 in the radial direction. Accordingly, the second coil 60 is disposed such that a portion thereof overlaps the first magnet 22 and the third magnet 23 in the radial direction. Additionally, the second coil 60 may be disposed such that a portion thereof overlaps the second plate 40 in the radial direction. The second coil 60 may be provided to reproduce sound in a low frequency range.

The first diaphragm 70 may be fixed to a first fixing ring 130. The first fixing ring 130 may be fixed to a first grill 120 and the first grill 120 may be fixed to the frame 10. The first diaphragm 70 may be provided to reproduce sound in a high frequency range.

The second diaphragm 80 may be fixed to a second fixing ring 150. The second fixing ring 150 may be fixed to a second grill 160 and the second grill 160 may be fixed to the frame 10. A dome 140 may be disposed at the center of the second diaphragm 80. The second diaphragm 80 may be provided to reproduce sound in a low frequency range.

The FPCB 90 supplies electric signals to the first coil 50 and the second coil 60. The FPCB 90 may be made of a soft material. A reinforcing plate 170 for reinforcing strength may be disposed to be attached to the FPCB 90.

A terminal 100 is disposed on the frame 10. The terminal 100 electrically connects the second coil 60 and the FPCB 90.

A first tuning part F1 may be disposed on the plate 2b 42. A second tuning part F2 may be disposed on the second grill 160. The first tuning part F1 and the second tuning part F2 are provided to change the tone or acoustic characteristics, and may be made of a mesh material including polyester, nylon, non-woven fabric, membrane filter, or the like.

The magnetic field moves to a space between the first plate 30 and the second plate 40. When an electric current is applied to the first coil 50 and the second coil 60 and thereby the first coil 50 and the second coil 60 become magnetic, the first coil 50 and the second coil 60 move according to the magnetic polarity of the first coil 50 and the second coil 60.

That is, when the first coil 50 and the first plate 30 have the same polarity, they push each other away so that the first coil 50 moves. In addition, when the second coil 60 and the second plate 40 have the same polarity, they push each other away so that the second coil 60 moves. On the other hand, when the first coil 50 and the first plate 30 have opposite polarities, they attract each other so that the first coil 50 moves. In addition, when the second coil 60 and the second plate 40 have opposite polarities, they attract each other so that the second coil 60 moves. As described above, the first diaphragm 70 and the second diaphragm 80 produce sound by vibrating air while moving.

Figure 4:
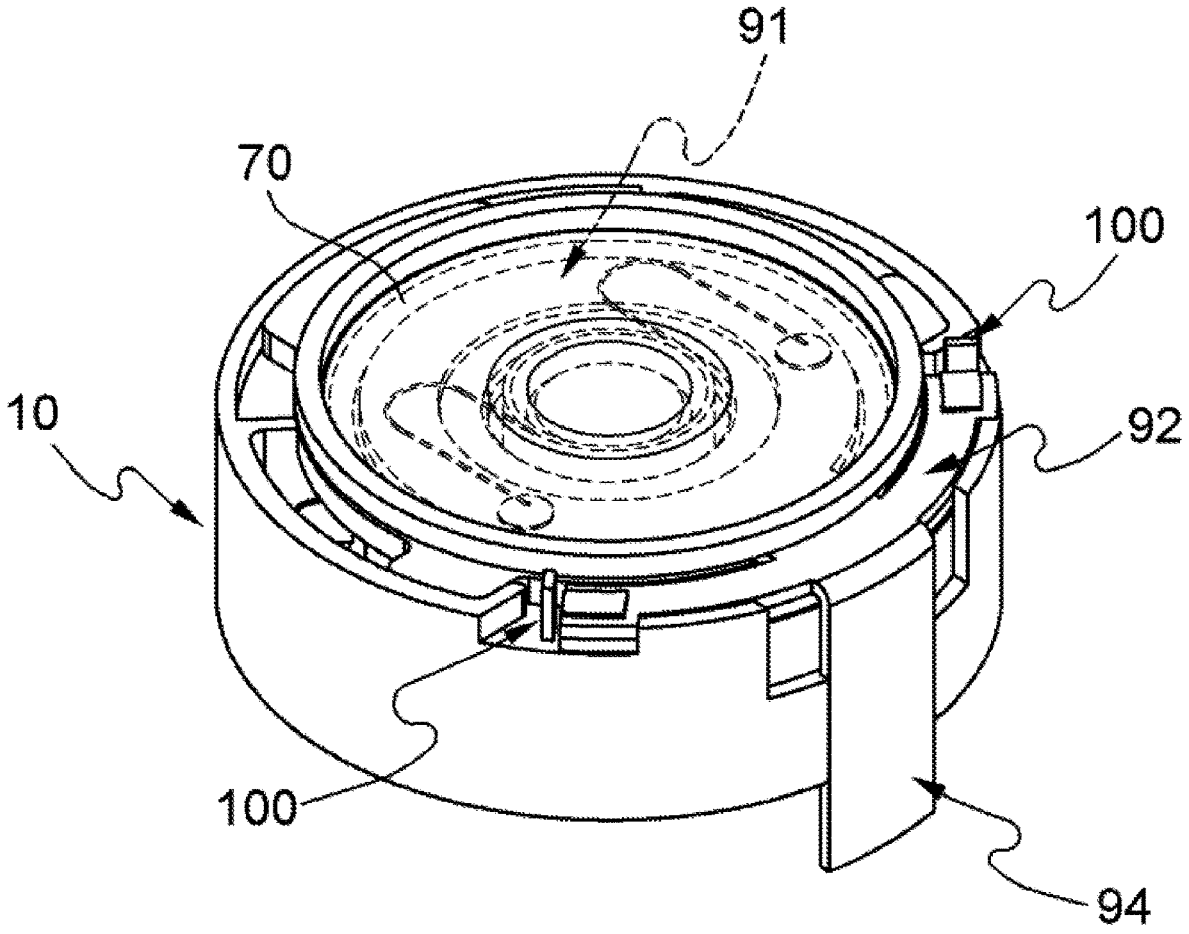
FIG. 4 is a view showing a state in which a flexible printed circuit board (FPCB) is disposed such that a portion thereof overlaps a first diaphragm.
Figure 5:
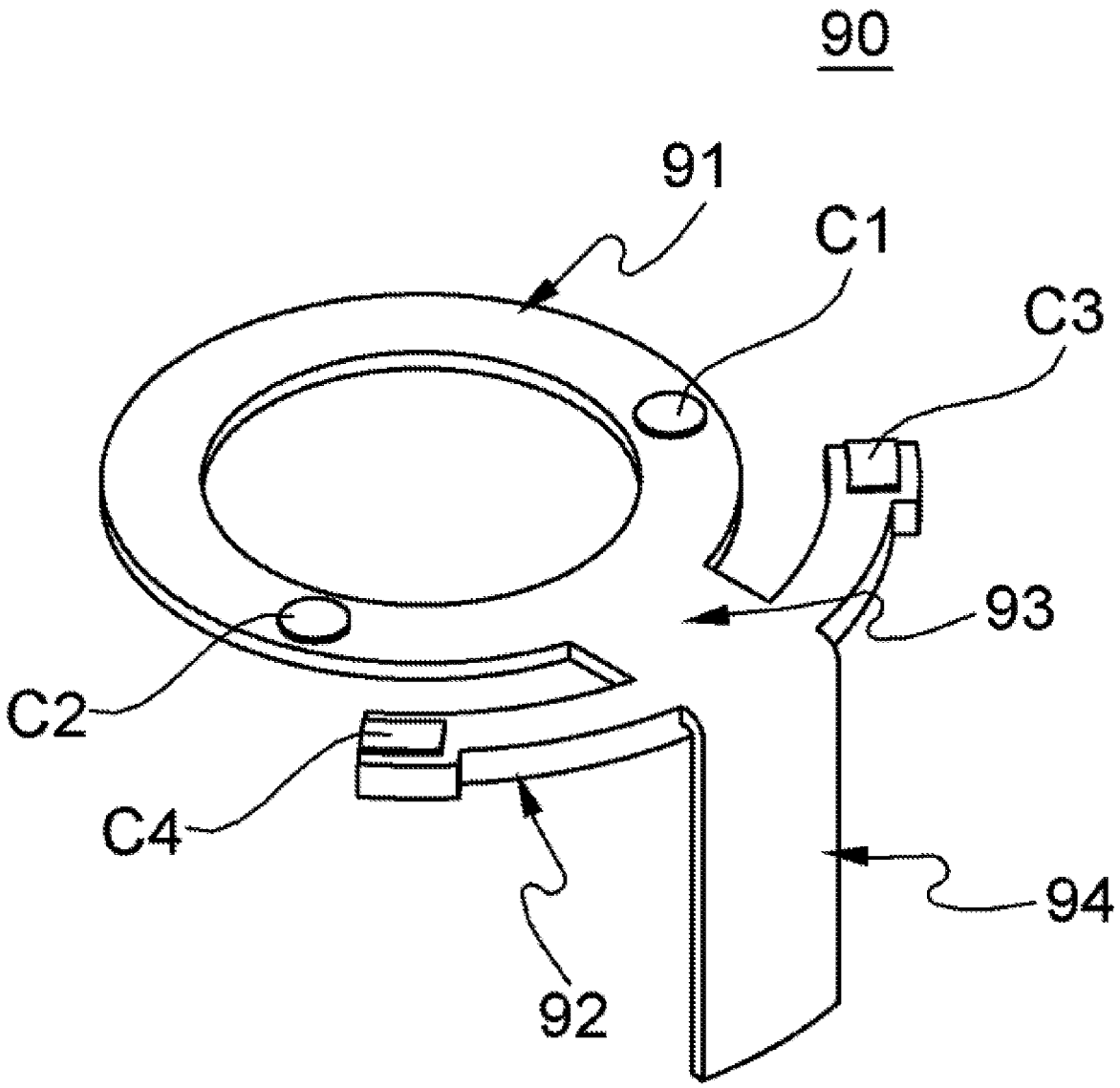
FIG. 5 is a perspective view of the FPCB.

FIG. 4 is a view showing a state in which the FPCB 90 is disposed such that a portion thereof overlaps the first diaphragm 70, and FIG. 5 is a perspective view of the FPCB 90.

Referring to FIGS. 4 and 5, in order to increase the size of the first diaphragm 70 in the radial direction, the FPCB 90 is disposed such that a portion thereof is positioned below the first diaphragm 70. The FPCB 90 may be divided into a first region 91, a second region 92, a third region 93, and an extended portion 94.

The first region 91 is a region that is disposed to overlap the first diaphragm 70 in the front-to-rear direction. The second region is a region that is disposed to be outside the first diaphragm 70 in the radial direction so as not to overlap the first diaphragm 70 in the front-to-rear direction. The third region 93 is a region that electrically connects the first region 91 and the second region 92. The first region 91 and the second region 92 are disposed apart from each other in the radial direction, and the third region 93 in the form of a bridge electrically connects the first region 91 and the second region 92. The first region 91 may be of a ring shape, and the second region 92 may be of an arc shape. The first coil 50 is positioned inside the first region 91 in the radial direction. The second region 92 may be supported by the separate reinforcing plate 170 and fixed to the frame 10. The extended portion 94 may be connected to the second region 92. The extended portion 94 may be bent from the second region 92 and disposed outside the frame 10. The extended portion 94 may be connected to an external signal line.

First contact points C1 and C2 connected to the first coil 50 may be disposed in the first region 91. The first contact points C1 and C2 may include contact point 1a C1 and contact point 1b C2. The contact point 1a C1 is connected to a first lead wire 51 of the first coil 50 and the contact point 1b C2 is connected to a second lead wire 52 of the first coil 50. The first coil 50 and the first contact points C1 and C2 may be connected by heat bonding.

Second contact points C3 and C4 connected to the second coil 60 may be disposed in the second region 92. The second contact points C3 and C4 may include contact point 2a C3 and contact point 2b C4. The contact point C3 is connected to the first lead wire 51 of the first coil 50 via the terminal 100 and the contact point 1b C2 is connected to the second lead wire 52 of the second coil 60. The terminal 100 and the second contact points C3 and C4 may be connected by heat bonding.

Figure 6:
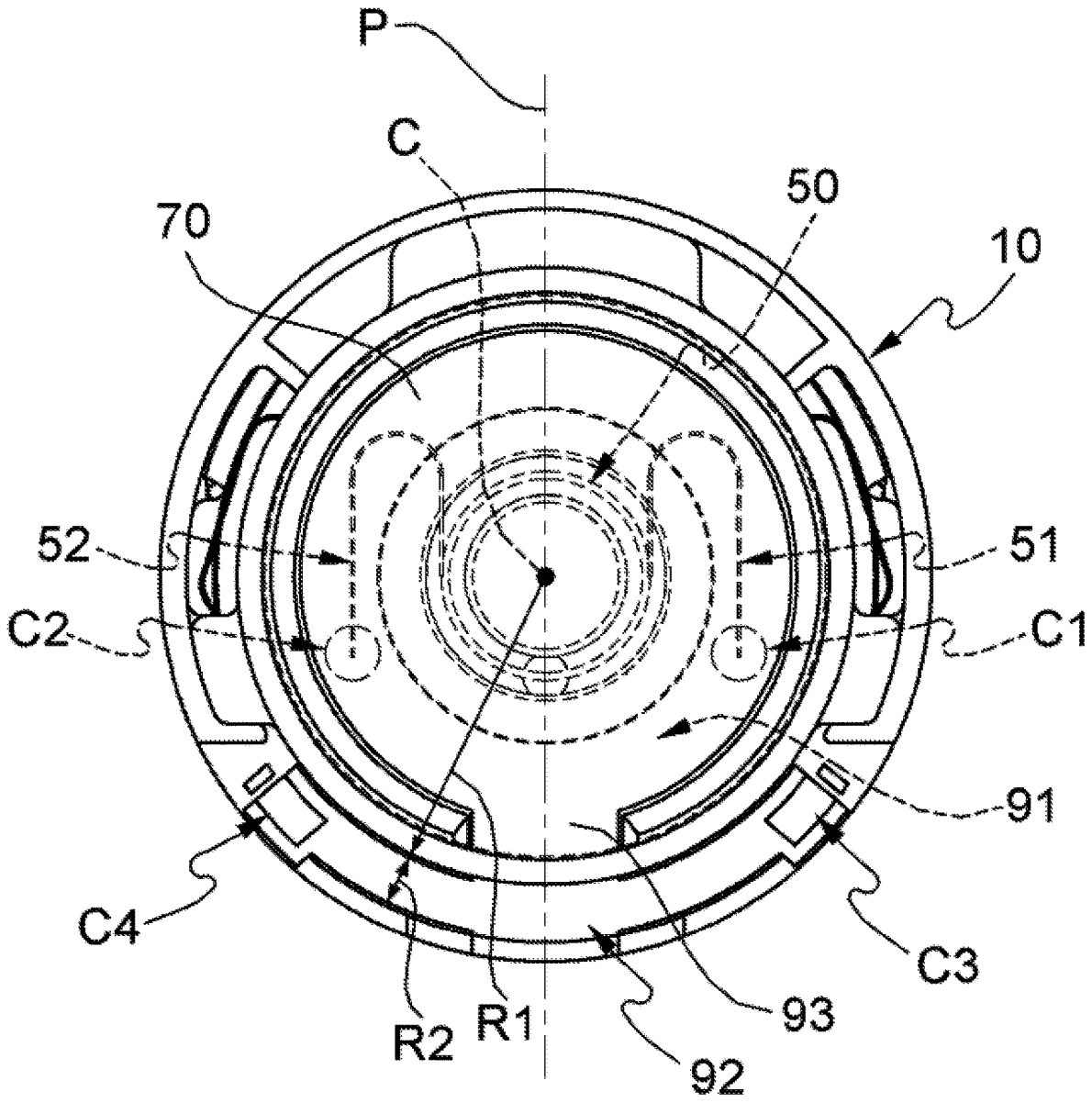
FIG. 6 is a plan view of a frame and the first diaphragm as viewed in the front-to-rear direction.

FIG. 6 is a plan view of the frame 10 and the first diaphragm 70 as viewed in the front-to-rear direction.

Referring to FIG. 6, since the first region 91 of the FPCB 90 is disposed below the first diaphragm 70, the radial width R2 of the second region 92 may be greatly reduced. As the radial width R2 of the second region 92 is reduced, the radial width R1 of the first diaphragm 70 can be increased, so that the intensity of the sound and the range of the sound can be increased.

Meanwhile, with respect to a reference line P passing through the center of the first coil 50, the contact point 1a C1 is disposed on one side of the reference line P, and the contact point 1b C2 is disposed on the other side of the reference line P. Such arrangement is made in consideration of the positions of the first lead wire 51 and the second lead wire 52 of the first coil 50. The first lead wire 51 of the first coil 50 is drawn out to one side of the reference line P and the second lead wire 52 of the second coil 60 is drawn out to the other side of the reference line P. Thus, it is advantageous for heat-bonding to dispose the contact point 1a C1 close to the first lead wire 51 and dispose the contact point 1b C2 close to the second lead wire 52.

Figure 7:
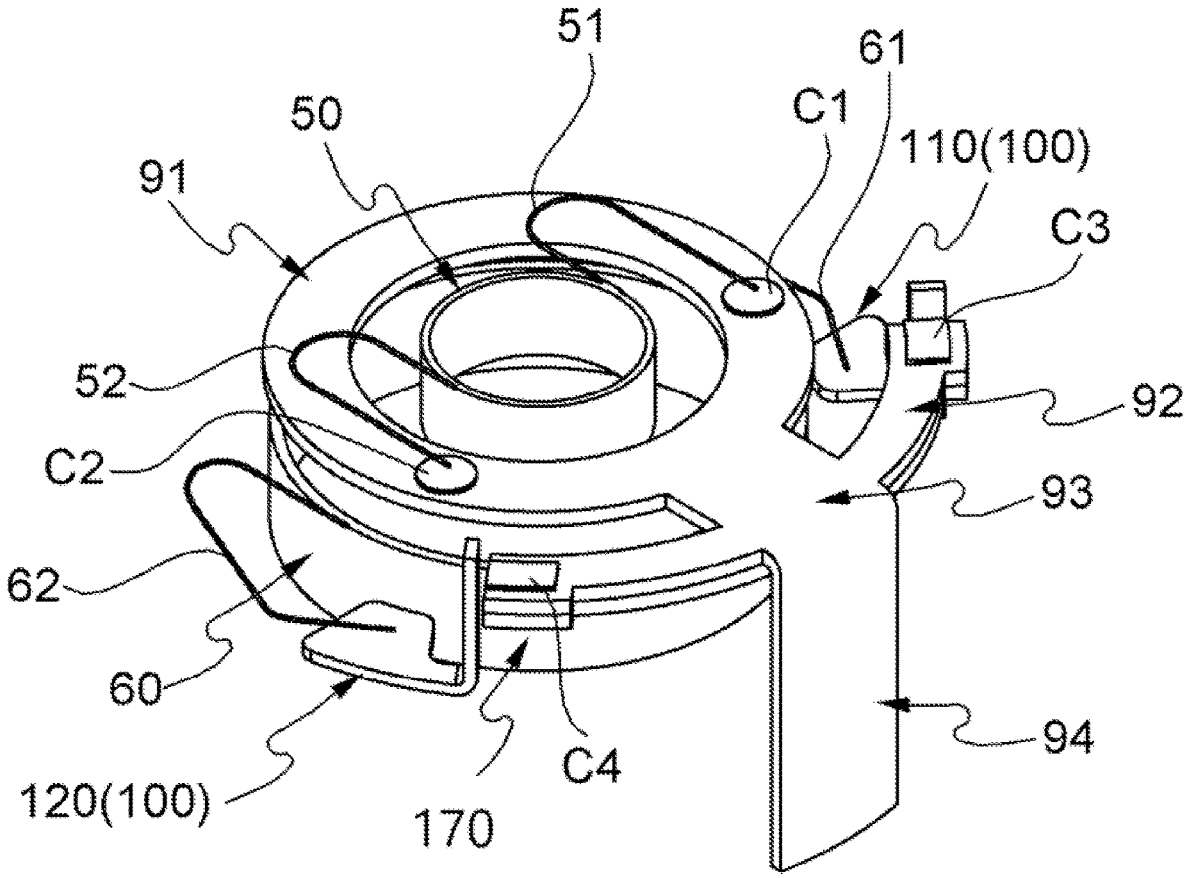
FIG. 7 is a diagram showing a connection state of the FPCB, a first coil, and a second coil.

FIG. 7 is a diagram showing a connection state of the FPCB 90, the first coil 50, and the second coil 60.

Referring to FIGS. 6 and 7, with respect to the front-to-rear direction, the first coil 50 is disposed at a relatively upper position and the second coil 60 is disposed at a lower position. In addition, the second coil 60 may be disposed outside the first coil 50 in the radial direction. In this way, the second coil 60 and the second region 92 of the FPCB 90 are positioned apart from each other, so that the first coil 50 and the second region 92 can be electrically connected through the terminal 100.

The terminal 100 may include a first terminal 110 and a second terminal 120. When the earphone is viewed from above, the first terminal 110 is disposed on one side of the reference line P and the second terminal 120 is disposed on the other side of the reference line P. Such arrangement is made in consideration of positions of a third lead wire and a fourth lead wire.

The third lead wire is connected to the first terminal 110. The first terminal 110 is connected to the contact point 2a C3 of the second region 92. The fourth lead wire is connected to the second terminal 120. The second terminal 120 is connected to the contact point 2b C4 of the second region 92.

Ends of the terminal 100 may be disposed higher than the second contact points C3 and C4 in the front-to-rear direction. When the ends of the terminal 100 are disposed higher than the second contact points C3 and C4, the second contact points C3 and C4 and the terminal 100 can be readily heat bonded together.

The first lead wire 51 and the second lead wire 52 of the first coil 50 and the third lead wire 61 and the fourth lead wire 62 of the second coil 60 may be disposed in a floating manner.

Figure 8:
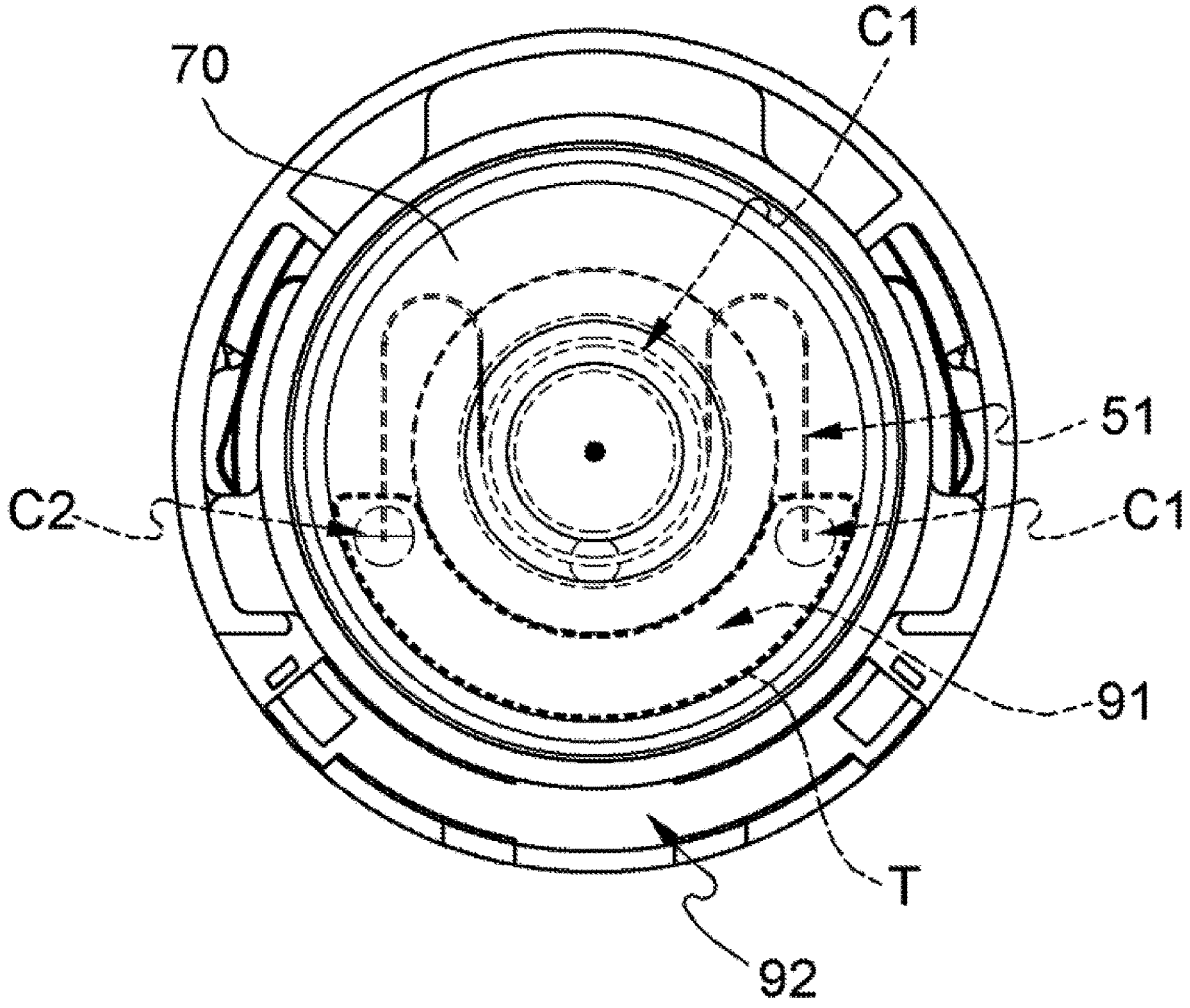
FIG. 8 is a view showing a first region of an FPCB according to a modified example.

FIG. 8 is a view showing the first region 91 of the FPCB 90 according to a modified example.

Referring to FIG. 8, the first region 91 of the FPCB 90 according to a modified example may be arc-shaped. In the case where the first region 91 is arc-shaped, the first lead wire 51 and the second lead wire 52 do not overlap the first region 91 in the front-to-rear direction, except for the heat-bonded regions. Therefore, a clearance for the first lead wire 51 and the second lead wire 52 can be ensured.

Figure 9:
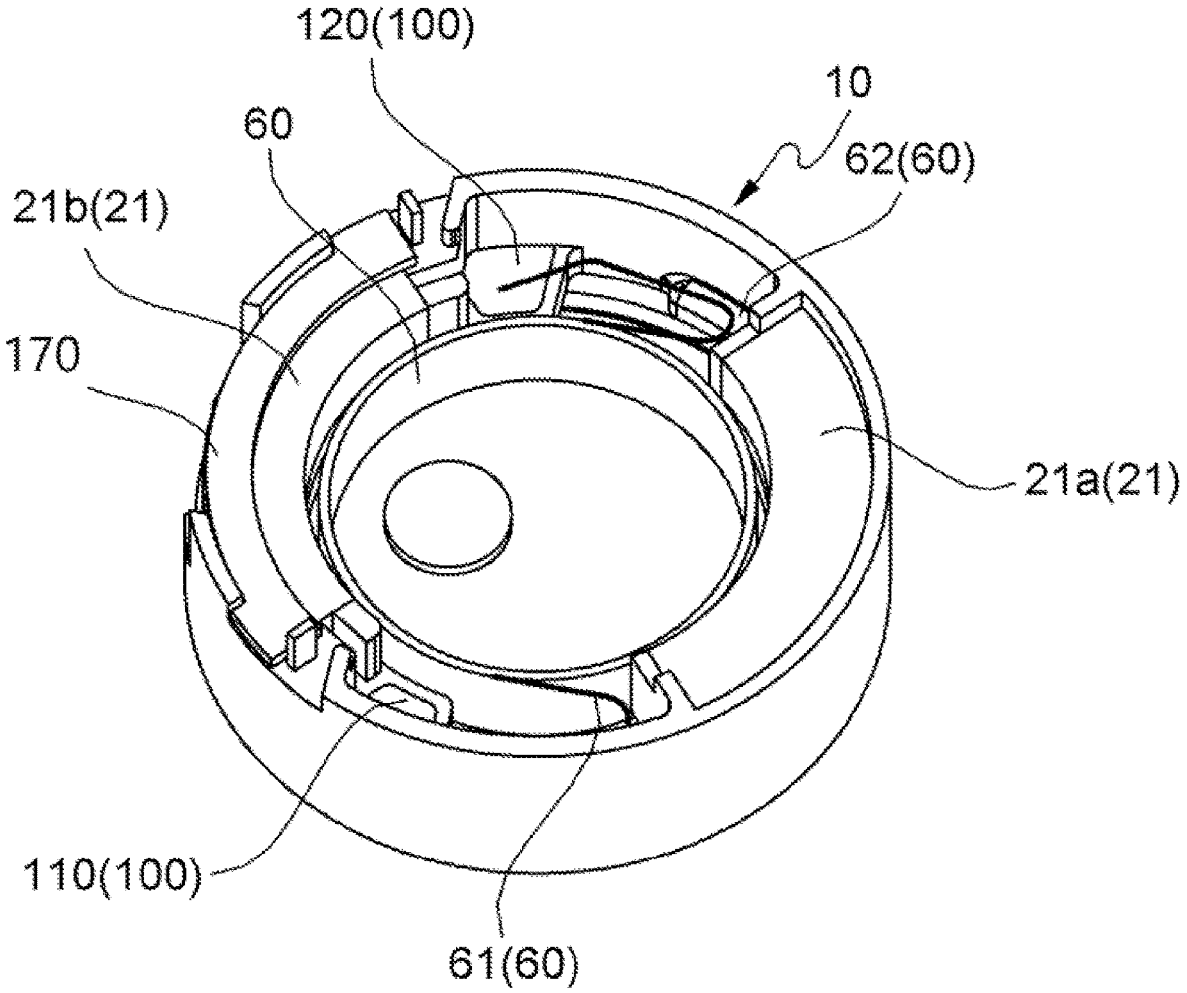
FIG. 9 is a view showing an internal state of the frame in which a terminal is mounted.

FIG. 9 is a view showing an internal state of the frame 10 in which the terminal 100 is mounted.

Referring to FIG. 9, the first terminal 110 and the second terminal 120 may be mounted in the frame 10. The first terminal 110 and the second terminal 120 may be disposed outside the second coil 60. The third lead wire 61 and the fourth lead wire 62 are heat bonded to the first terminal 110 and the second terminal 120, respectively, in a floating state. Meanwhile, the first magnet 21 is mounted on the frame 10. The first magnet 21 may include magnet 1a 21*a* and magnet 1b 21*b*. The magnet 1a 21*a* and the magnet 1b 21*b* may each be of a curved bar shape. The magnet 1a 21*a* and the magnet 1b 21*b* are disposed apart from each other in the circumferential direction. The shape and positions of the magnet 1a 21*a* and magnet 1b 21*b* are determined to secure the space for the third lead wire 61 and the fourth lead wire 62. In the circumferential direction, the third lead wire 61 or the fourth lead wire 62 may be disposed between the magnet 1a 21*a* and the magnet 1b 21*b*.

Meanwhile, the reinforcing plate 170 may be disposed on the frame 10. The reinforcing plate 170 may be coupled to the second region 92 of the FPCB 90 and serve to support the second region 92. Since the width of the second region 92 in the circumferential direction is narrow, the width of the reinforcing plate 170 in the circumferential direction is also narrow. Therefore, the size of the first diaphragm 70 can be increased.

Figure 10:
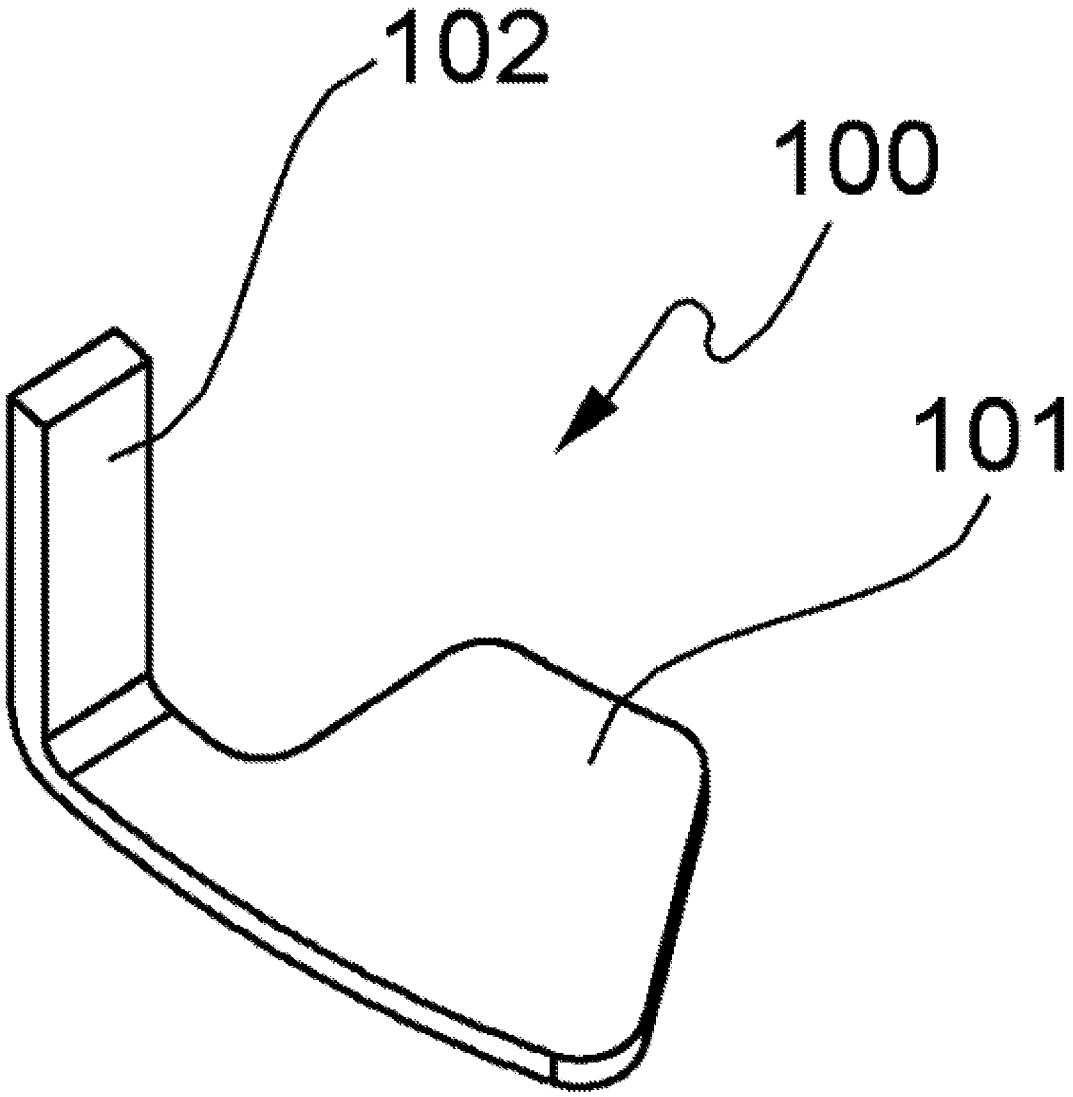
FIG. 10 is a perspective view of the terminal.
Figure 11:
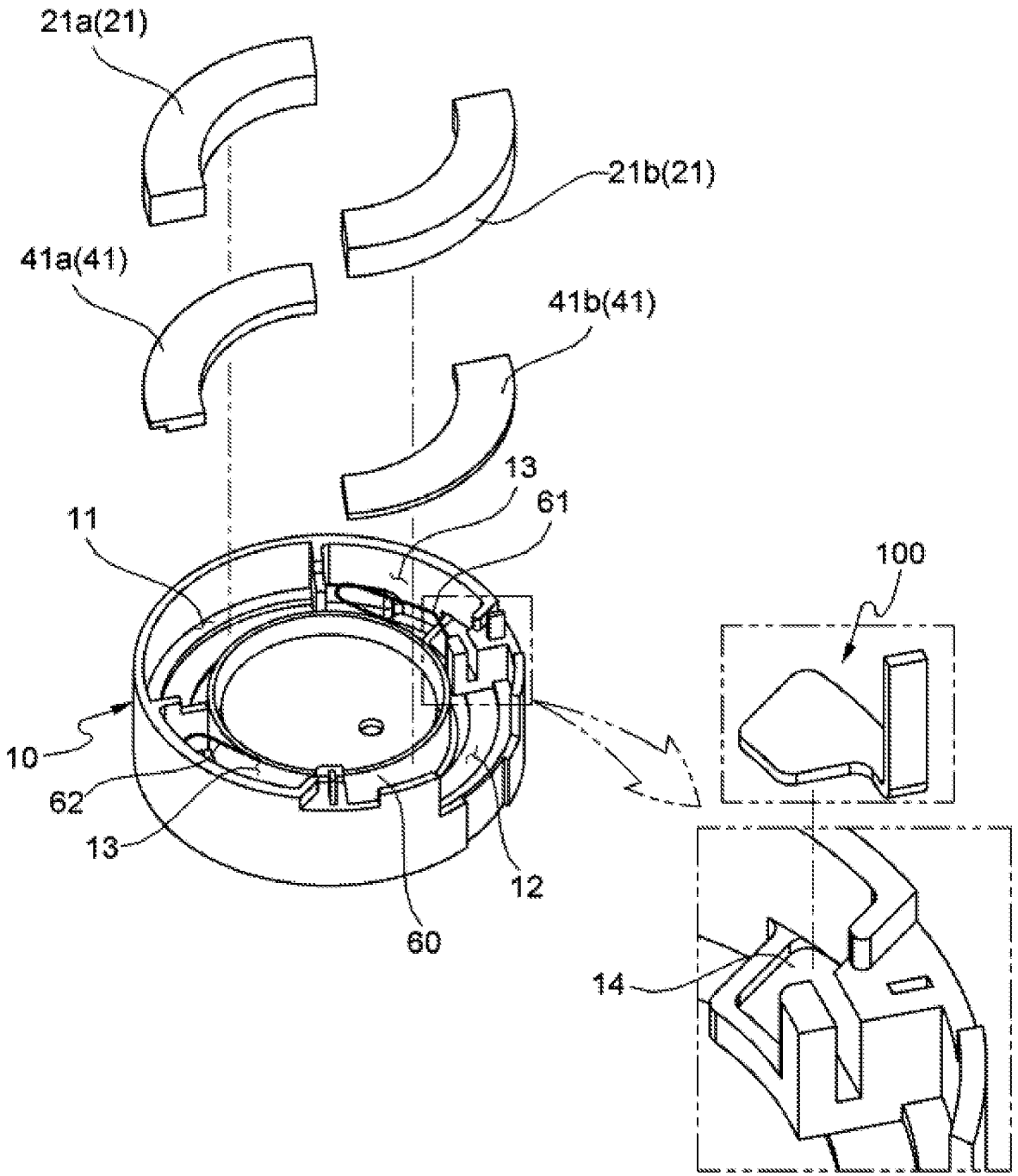
FIG. 11 is an exploded view of the frame shown in FIG. 9.

FIG. 10 is a perspective view of the terminal 100 and FIG. 11 is an exploded view of the frame 10 shown in FIG. 9.

Referring to FIGS. 10 and 11, the terminal 100 may include a body 101 and a pin 102 that is vertically bent from the body 101. The body 101 is a region that is connected to the third lead wire 61 or the fourth lead wire 62, and the pin 102 is a region that is connected to the second region 92 of the FPCB 90.

The frame 10 may include a first receiving portion 11, a second receiving portion 12, and third receiving portions 13. The first receiving portion 11 and the second receiving portion 12 may be disposed apart from each other in the circumferential direction with the third receiving portions 13 interposed therebetween.

The magnet 1a 21*a* is mounted in the first receiving portion 11. The magnet 1b 21*b* is mounted in the second receiving portion 12. The third lead wire 61 of the second coil 60 is disposed in one of the two third receiving portions 13, and the fourth lead wire 62 of the second coil 60 is disposed in the other third receiving portion 13.

Meanwhile, the plate 2a 41 is disposed in the first receiving portion 11. In the front-to-rear direction, the plate 2a 41 may be disposed between the magnet 1a 21*a* and the first receiving portion 11. In addition, the plate 2b 42 is disposed in the second receiving portion 12. In the front-to-rear direction, the plate 2b 41 may be disposed between the magnet 1b 21*b* and the second receiving portion 12.

The frame 10 includes a terminal mounting portion 14 on which the terminal 100 is mounted. The terminal mounting portion 14 may be disposed in the third receiving portion 13. The terminal mounting portion 14 may be formed to be recessed from a partition wall of the frame 10 to secure a space in which the body 101 of the terminal 100 is accommodated. The terminal mounting portion 14 may be disposed on a circumferential side surface of the third receiving portion 13 in consideration of a clearance for the third lead wire 61 of the fourth lead wire 62.

Figure 12:
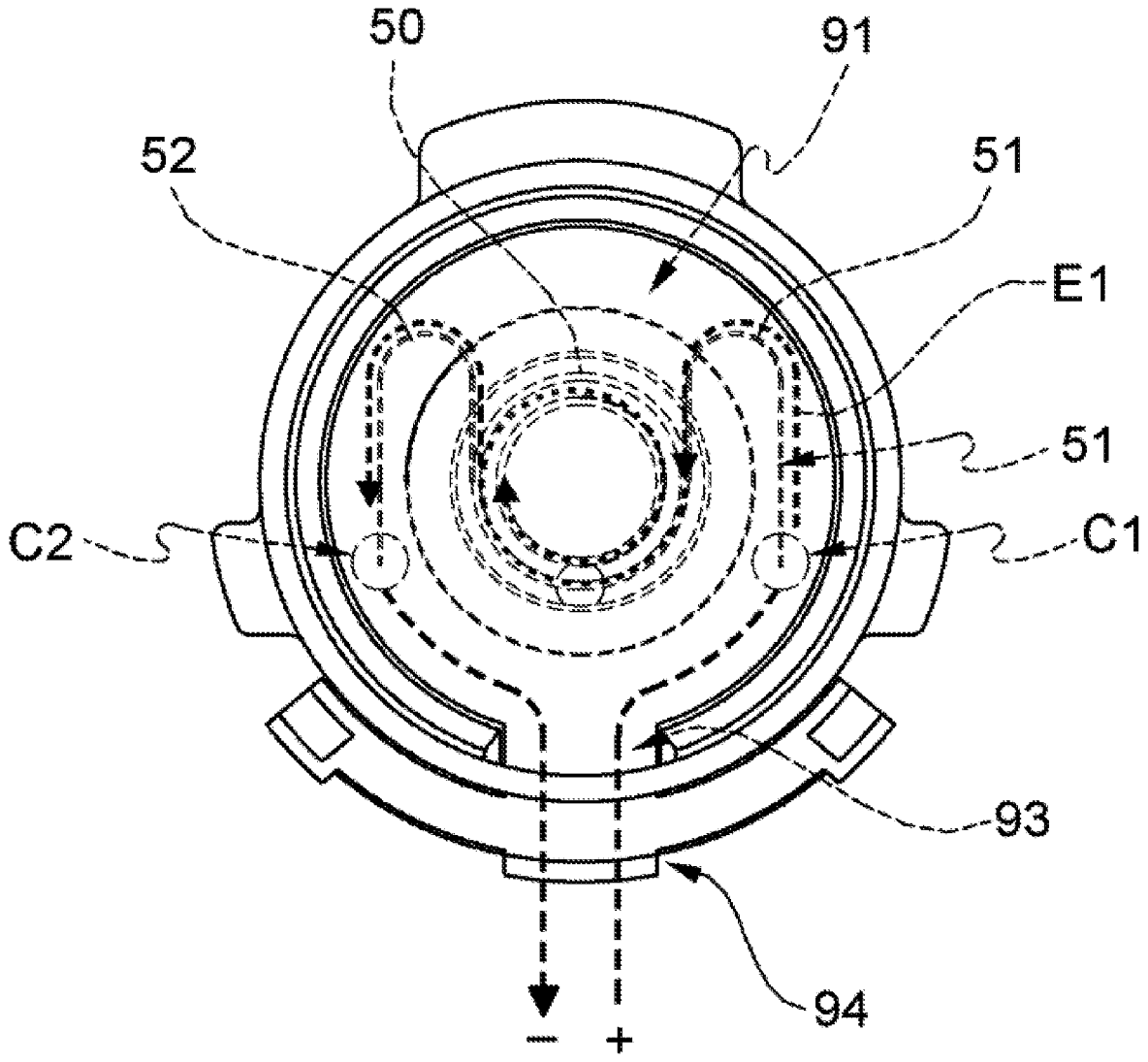
FIG. 12 is a view showing a current flow through the first coil for reproducing sound in a high frequency range.

FIG. 12 is a view showing a current flow through the first coil 50 for reproducing sound in a high frequency range.

Referring to FIG. 12, in order to reproduce sound in a high frequency range, a path E1 of an electric current passing through the first coil 50 is generated. A current flow is formed from an external signal line to the contact point 1a C1 via the second region 92, the third region 93, and the first region 91 through the extended portion 94. In addition, the current flow passes through the first coil 50 through the first lead wire 51 at the contact point 1a C1, and a current flow is formed to the contact point 1b C2 in the first region 91 through the second lead wire 52. Also, the current flow is formed to the external signal line through the first region at the contact point 1b C2, the third region 93, and the extended portion 94.

Figure 13:
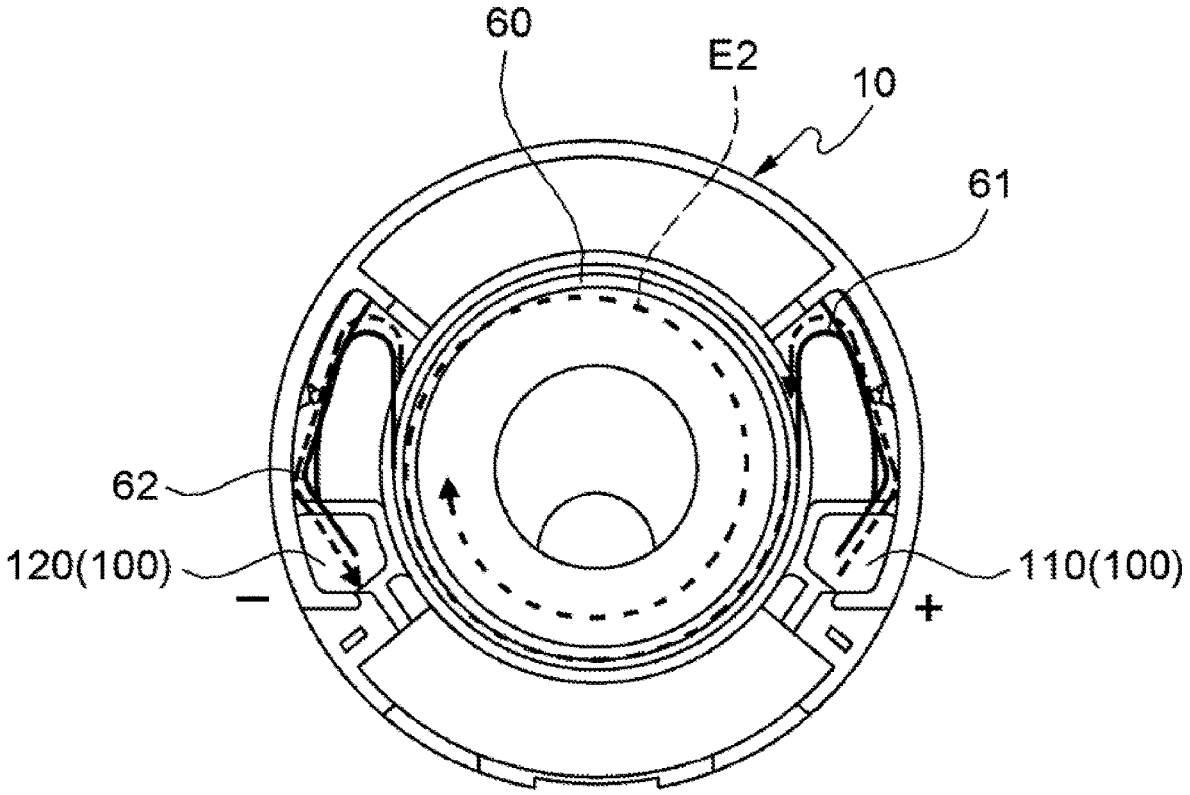
FIG. 13 is a view showing a current flow from the second coil to the terminal for reproducing sound in a low frequency range.
Figure 14:
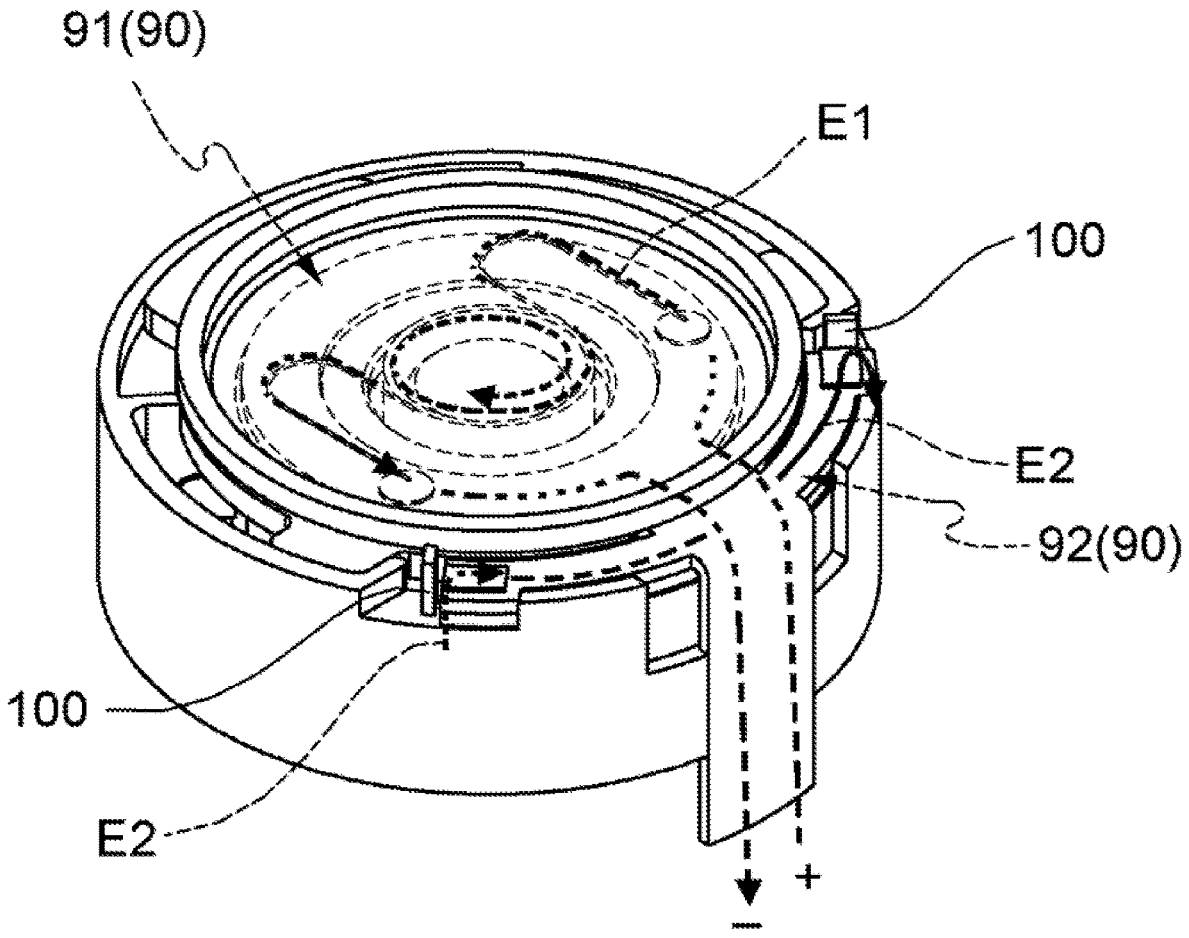
FIG. 14 is a view showing a current flow from a terminal to the FPCB for reproducing sound in a low frequency range.

FIG. 13 is a view showing a current flow from the second coil 60 to the terminal 100 for reproducing sound in a low frequency range, and FIG. 14 is a view showing a current flow from the terminal 100 to the FPCB for reproducing sound in a low frequency range.

Referring to FIGS. 12 to 14, in order to reproduce sound in a low frequency range, a path E2 of an electric current passing through the second coil 60 is formed. A current flow is formed from the external signal line to the contact point 2a C3 of the second region 92 through the extended portion 94. In addition, a current flow is formed from the second contact points C3 and C4 to the second coil 60 through the first terminal 110 and the third lead wire 91. A current flow is formed from the second coil 60 to the contact point 2b C4 of the second region 92 through the fourth lead wire 62 and the second terminal 120. Also, a current flow is formed from the contact point 2b C4 to the external signal line through the second region 92 and the extended portion 94.

Figure 15:
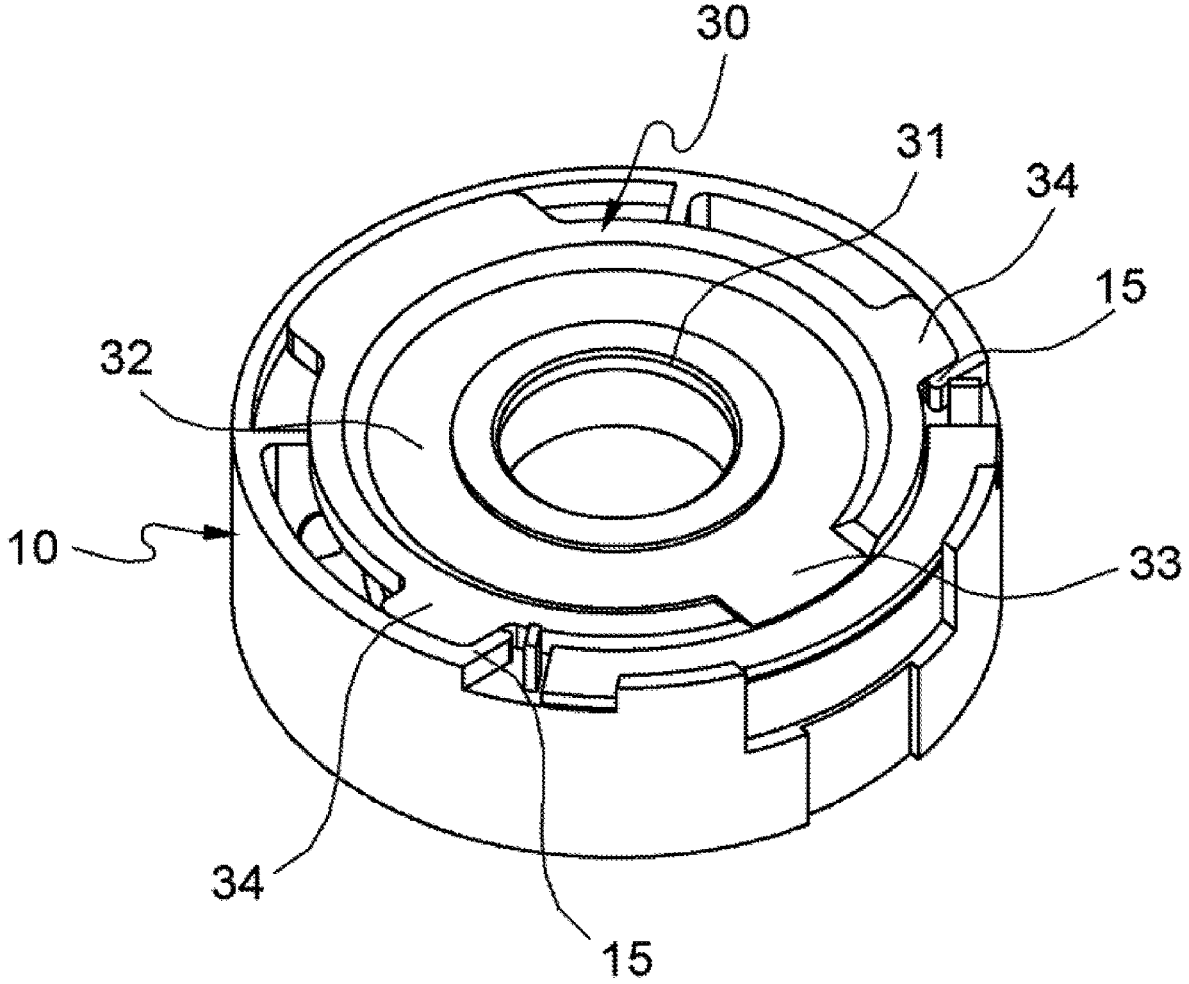
FIG. 15 is a view showing a coupled state of a first plate and the frame.

FIG. 15 is a view showing a coupled state of the first plate 30 and the frame 10.

Referring to FIG. 15, the first plate 30 may be a circular plate. The first plate 30 may have a hole 31 positioned at the center. The first coil 50 is positioned inside the hole 31. Also, the first plate 30 may include a first groove 32 and a second groove 33. The first groove 32 may be formed in an annular shape along the circumference of the hole 31. The first groove 32 is recessed from an upper surface of the first plate 30 to form a space in which the first region 91 of the FPCB 90 is accommodated. The second groove 33 is connected to the first groove 32 and recessed from the upper surface of the first plate 30 to form a space in which the third region 93 of the FPCB 90 is accommodated.

Meanwhile, the first plate 30 may include a second guide 34. The second guide 34 may protrude from an outer edge of the first plate 30 in the radial direction. A plurality of second guides 34 may be arranged along the circumference of the first plate 30. The second guide 34 may be in contact with a first guide 15 protruding from an inner wall of the frame 10 to align the positions of the configurations for reproducing sound in a high frequency range, that is, the positions of the first coil 50, the first diaphragm 70, the second magnet 22, the third magnet 23, the FPCB 90, and the like.

Figure 16:
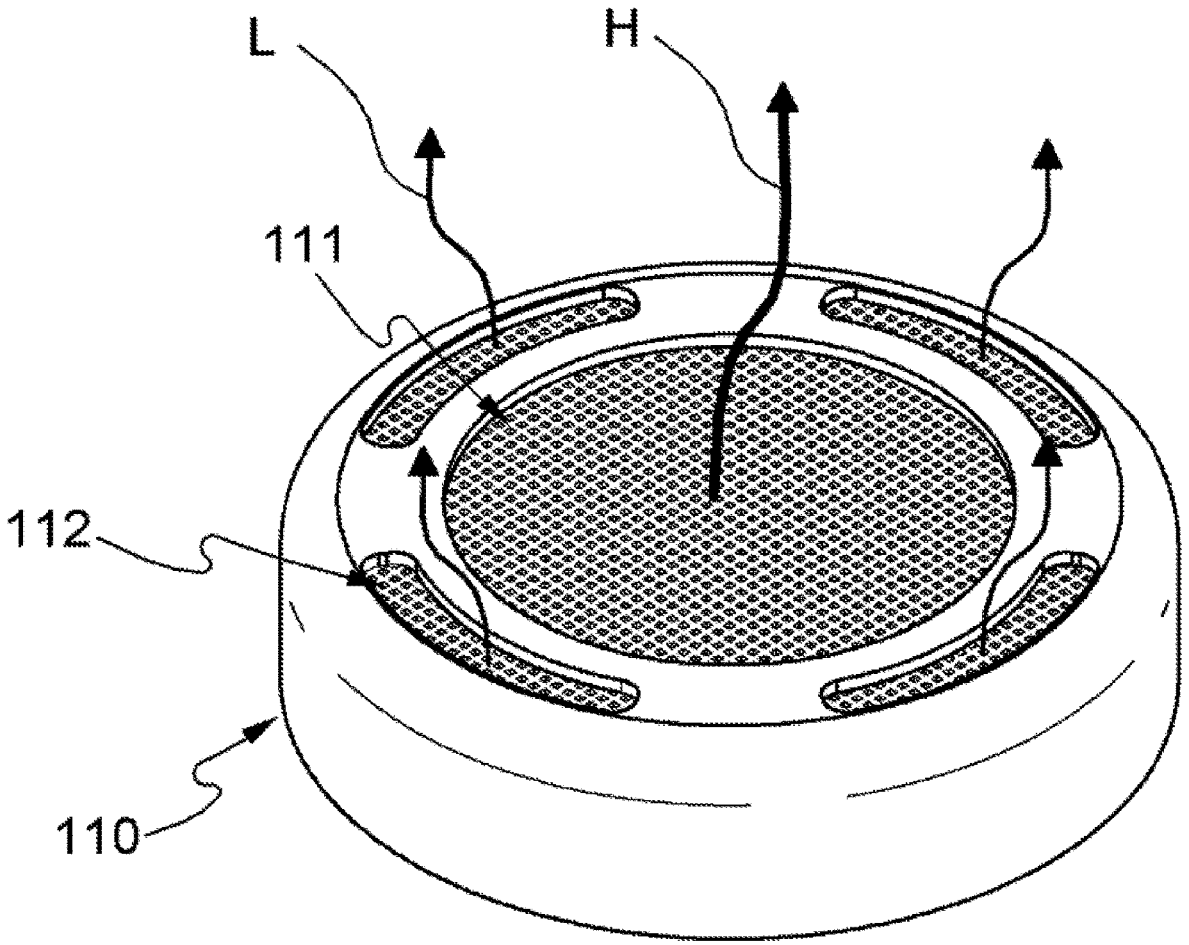
FIG. 16 is a view showing a protector.

FIG. 16 is a view showing a protector 110.

Referring to FIG. 16, the protector 110 is obtained by insert injecting a metal mesh onto a molded article of a rubber-based material. The rubber-based molded article may be elastically deformed and coupled to the frame 10 on a side where the first diaphragm 70 is disposed. The molded article is in close contact with a first fixing ring 130, thereby improving the sealing property inside the molded article. The molded article may include a first opening portion 111 and second opening portions 112. A plurality of second opening portion 112 may be arranged along the circumference of the first opening portion 111. Sound in a high frequency range may be emitted through the first opening portion 111 and sound in a low frequency range may be emitted through the second opening portions 112.

Since the molded article of an elastic material is in close contact with an outer case, a sealing structure capable of preventing the inflow of water or foreign matter can be achieved without an additional configuration, such as an adhesive or a tape.

On the other hand, in the case where a metal mesh having a different grid size is applied to each protector 110, various sound adjustments are possible without a separate sound adjustment configuration.

Figure 17:
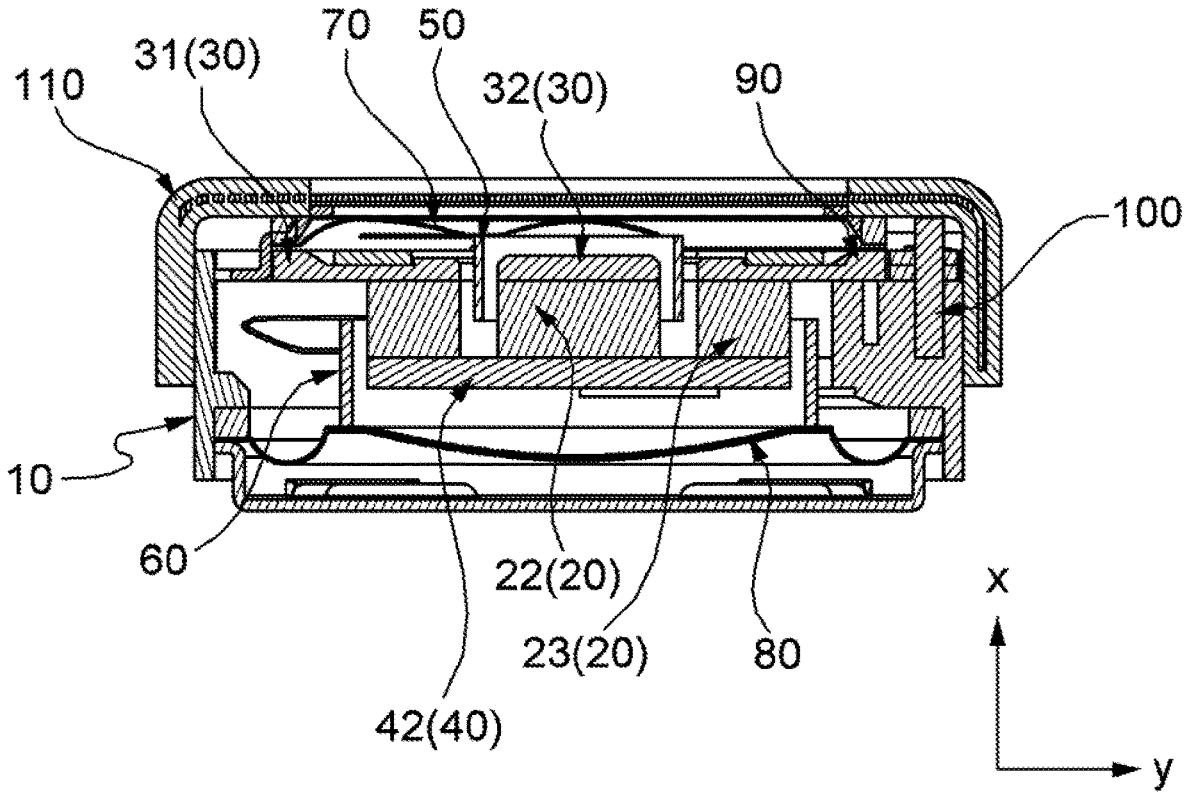
FIG. 17 is a view showing a speaker unit according to another embodiment.

FIG. 17 is a view showing a speaker unit according to another embodiment.

Referring to FIG. 17, in the speaker unit according to another embodiment, a first magnet 21 may be omitted, and only a second magnet 22 and a third magnet 23 may be included. Plate 1*a* 31 is in contact with one surface of the third magnet 23. Plate 2*a* 41 is omitted, and plate 2b 42 may be in contact with the other surface of the second magnet 23 and the other surface of the third magnet 23.

According to the embodiment, by securing the size of the diaphragm, the intensity and reproduction range of sound can be increased.

According to the embodiment, the terminal connected to the coil of the diaphragm for reproducing sound in a low frequency range is aligned and bonded to the FPCB, thereby facilitating assembly.

Although the preferred embodiments of the speaker unit have been disclosed for illustrative purposes, those skilled in the art will appreciate that various modifications, additions and substitutions are possible, without departing from the scope and spirit of the invention as disclosed in the accompanying claims. Therefore, it should be noted that such modifications or changes belong to the claims of the present invention.

What is claimed is:

1. A speaker unit for an earphone, comprising:

a frame;

a magnet;

a first plate fixed to the frame and in contact with one side of the magnet;

a second plate fixed to the frame and in contact with another side of the magnet;

a first coil disposed to overlap the magnet and the first plate in a radial direction;

a second coil disposed to overlap the magnet and the second plate in the radial direction;

a first diaphragm disposed in front of the magnet and having the first coil fixed thereto;

a second diaphragm disposed behind the magnet; and a flexible printed circuit board (FPCB), wherein the FPCB includes a first region including a first contact point connected to the first coil and a second region including a second contact point connected to the second coil and in a front-to-rear direction, the first region is disposed to overlap the first diaphragm in the front-to-rear direction while the second region is disposed not to overlap the first diaphragm.

2. The speaker unit of claim 1, wherein the first region and the second region are disposed apart from each other in the radial direction and the FPCB comprises a third region that electrically connects the first region and the second region.

3. The speaker unit of claim 2, wherein the first plate comprises a hole in which the first coil is positioned, a first groove disposed along a circumference of the hole and having the second region disposed therein, and a second groove connected to the first groove and having the third region disposed therein.

4. The speaker unit of claim 2, wherein the frame comprises a first guide protruding inward from an inner surface thereof, the first plate comprises a second guide protruding radially from an outer surface thereof, and a position of the first plate is aligned as the second guide is in contact with the first guide.

5. The speaker unit of claim 1, further comprising a terminal disposed on the frame, wherein one side of the terminal is connected to the second coil and another side of the terminal is connected to the second contact point.

6. The speaker unit of claim 5, wherein ends of the terminal are disposed higher than the FPCB in the front-to-rear direction.

7. The speaker unit of claim 5, wherein the terminal comprises a first terminal connected to a third lead wire on one side of the second coil and a second terminal connected to a fourth lead wire on another side of the second coil, the first terminal is disposed on one side of a reference line that passes through a center of the second coil in the radial direction, and the second terminal is disposed on another side of the reference line.

8. The speaker unit of claim 1, wherein the first region is disposed on the first plate, the speaker unit comprises a fixing ring for fixing the first diaphragm, and the first region is disposed between the first coil and the fixing ring in the radial direction.

9. The speaker unit of claim 1, wherein the first contact point comprises contact point 1a in contact with a first lead wire of the first coil and contact point 1b in contact with a second lead wire of the first coil, and with respect to a reference line passing through a center of the first coil in the radial direction, the contact point 1a is disposed on one side of the reference line and the contact point 1b is disposed on another side of the reference line.

10. The speaker unit of claim 1, wherein the second contact point comprises contact point 2a in contact with a third lead wire of the second coil and contact point 2b in contact with a fourth lead wire of the second coil, and with respect to a reference line passing through a center of the second coil in the radial direction, the contact point 2a is disposed on one side of the reference line and the contact point 2b is disposed on another side of the reference line.

11. The speaker unit of claim 1, wherein the first region is of a ring shape or an arc shape.

12. The speaker unit of claim 1, wherein the magnet comprises magnet 1a and magnet 1b that are disposed along a circumferential direction, the magnet 1a and the magnet 1b are disposed apart from each other with a space therebetween, and a third lead wire and a fourth lead wire of the second coil are disposed in the space.

13. The speaker unit of claim 1, wherein the frame comprises a first receiving portion and a second receiving portion that are disposed apart from each other along a circumferential direction, and a third receiving portion disposed between the first receiving portion and the second receiving portion, the magnet comprises magnet 1a and magnet 1b that are disposed in each of the first receiving portion and the second receiving portion, respectively, and a second lead wire of the second coil is positioned in the third receiving portion.

14. The speaker unit of claim 13, further comprising a terminal connected to the second lead wire of the second coil, wherein the frame comprises a terminal mounting portion disposed in the third receiving portion and having the terminal mounted thereon.

* * * * *